US006883990B2

(12) United States Patent
Shih

(10) Patent No.: US 6,883,990 B2
(45) Date of Patent: Apr. 26, 2005

(54) COSMETICS CONTAINER

(75) Inventor: Yu-Ching Shih, Yung Kung (TW)

(73) Assignee: Hawthorn Enterprise Co., Ltd., Tainan Hsien (TW)

( * ) Notice: Subject to any disclaimer, the term of this patent is extended or adjusted under 35 U.S.C. 154(b) by 120 days.

(21) Appl. No.: 10/609,379

(22) Filed: Jul. 1, 2003

(65) Prior Publication Data

US 2005/0000849 A1 Jan. 6, 2005

(51) Int. Cl.[7] ..... A46B 11/00

(52) U.S. Cl. ..... 401/127; 401/123; 401/129; 206/15.2; 206/229; 206/581

(58) Field of Search ..... 206/209, 15.2, 206/361, 385, 823, 229, 581, 235; 132/317, 313, 297, 293; 15/114, 159.1; 401/116, 123, 124–129

(56) References Cited

U.S. PATENT DOCUMENTS 2,272,641 A * 2/1942 Mureau ..... 401/288
2,287,321 A * 6/1942 Mureau ..... 401/174
2,538,447 A * 1/1951 Finney ..... 401/127
3,802,023 A * 4/1974 Spatz ..... 15/192
4,498,490 A * 2/1985 Seidler ..... 132/218
4,984,920 A * 1/1991 O'Neill ..... 401/127
5,040,914 A * 8/1991 Fitjer ..... 401/127
5,366,311 A * 11/1994 Powers ..... 401/194
5,397,195 A * 3/1995 Goncalves ..... 401/277
6,082,918 A * 7/2000 Gueret ..... 401/126
6,764,239 B1 * 7/2004 Kim ..... 401/108

* cited by examiner

*Primary Examiner*—Anthony D. Stashick
*Assistant Examiner*—Jerrold D Johnson
(74) *Attorney, Agent, or Firm*—Rosenberg, Klein & Lee

(57) ABSTRACT

A cosmetics container includes a hollow container and a cover unit. The cover unit is composed of a connecting cover, a brush, a revolving base and a revolving cover. The brush is normally positioned in the connecting cover of the cover unit. To do makeup, the revolving cover is rotated with the revolving base, and simultaneously the brush is extended out of the cover unit.

2 Claims, 4 Drawing Sheets

COSMETICS CONTAINER

BACKGROUND OF THE INVENTION

1. Field of the Invention

This invention relates to a cosmetics container, particularly to one composed of a container and a cover unit, having a brush positioned inside the cover unit for facilitating it to be carried together with cosmetics stored in the container for convenient use.

2. Description of the Prior Art

A conventional cosmetics container 70, as shown in FIG. 6, includes a hollow case 71 for storing cosmetics therein. The hollow case 71 has its upper opening fitted with an intermediate cover 72, and a top cover 73 is threadably covered on the hollow box 71. To do making up, a user has to bring both the cosmetics container 70 and a brush 80 with her, so that she can use the cosmetics in the cosmetics container 70 with the brush 80.

However, in practical use, the common cosmetics container 70 has the following defects.

1. To do makeup, a user must separately bring the cosmetics container 70 and the brush 80 at the same time, increasing trouble and taking too much space in a small bag.

2. The cosmetics container 70 and the brush 80 are separated from each other; therefore it is most likely that a user may forget bringing either of them.

SUMMARY OF THE INVENTION

The objective of the invention is to offer a cosmetics container including a hollow container and a cover unit. The cover unit covered on the upper end of the hollow container is composed of a connecting cover, a brush, a revolving base and a revolving cover, with the brush normally positioned in the connecting cover. In using, turn around the revolving cover to move forward together with the revolving base and actuate the brush to move forward together and extend out of the cover unit for use, enabling a user to do makeup conveniently.

BRIEF DESCRIPTION OF DRAWINGS

This invention will be better understood by referring to the accompanying drawings, wherein.

DETAILED DESCRIPTION OF THE PREFERRED EMBODIMENT

Figure 1:
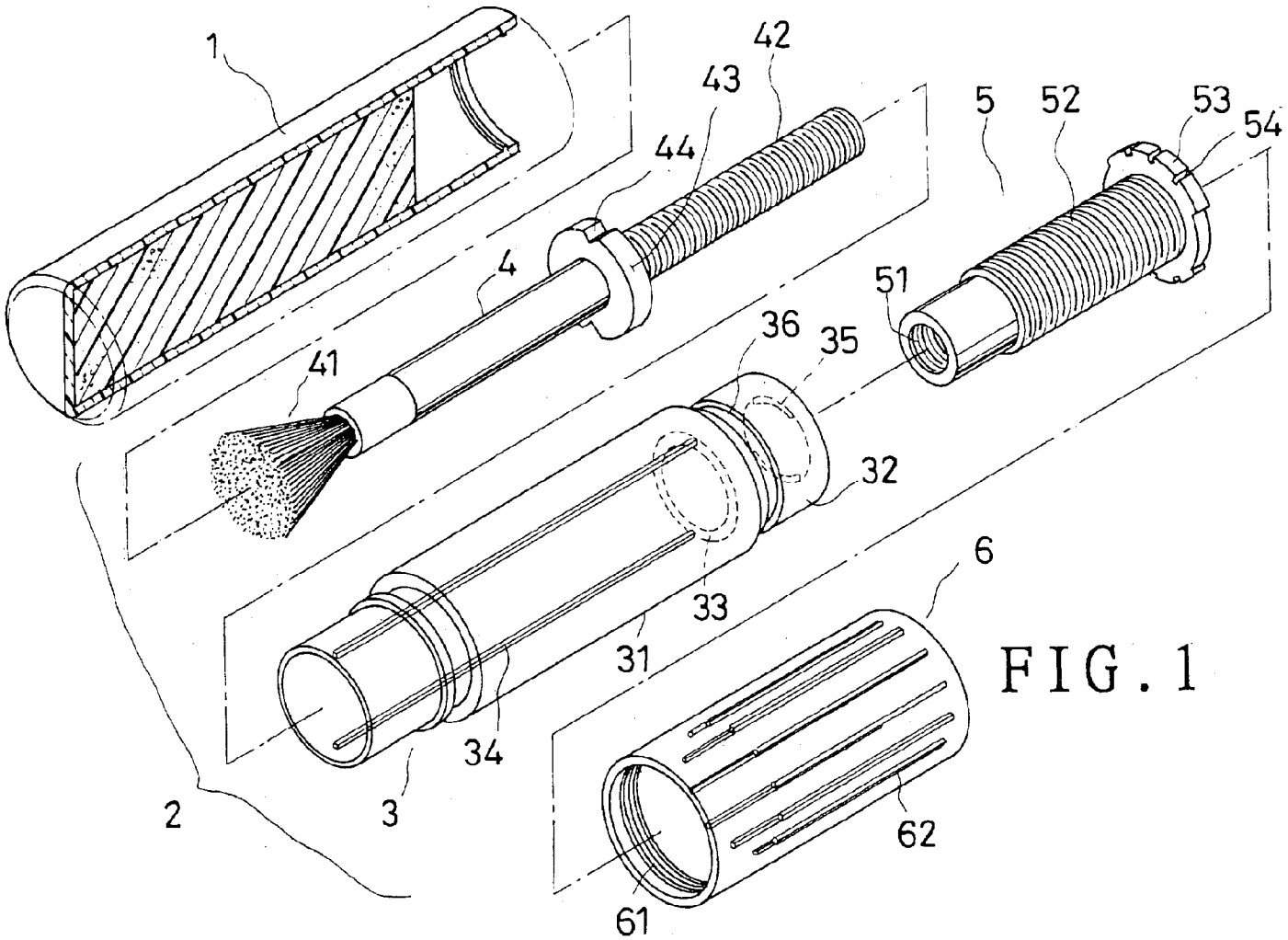
FIG. 1 is an exploded perspective view of a cosmetics container in the present invention.

A preferred embodiment of a cosmetics container in the present invention, as shown in FIGS. 1 to 4, includes a hollow container 1 and a cover unit 2 combined together.

The container 1 is preferably shaped tubular, formed with a top opening and has its upper end fitting with the cover body 2 and its inner space storing cosmetics therein, such as a powder cake, eye shadow cream and the like.

The cover unit 2 covered on the container 1 is composed of a connecting cover 3, a brush 4, a revolving base 5 and a revolving cover 6.

The connecting cover 3 is preferably a hollow tube consisting of a front elongate tube 31 and a rear short tube 32 formed integral, having its opposite end respectively formed with an opening. The front tube 31 has a larger diameter than the rear tube 32, with a stepped portion 33 formed between the front and the rear tube 31, 32.

The brush 4 has one end provided with a brushing member 41 and the other end formed with a reversely threaded portion 42 to be inserted through the front and the rear tube 31, 32. The brush 4 has its intermediate portion fixed with a stop ring 43 having two guide grooves 44 formed oppositely on the circumferential edge to fit with two elongate guide projections 34 on the inner wall of the front tube 31.

The revolving base 5 has its inner end formed with a threaded hole 51 to screw with the reversely threaded portion 42 of the brush 4 and its outer wall formed with a right-handed threads portion 52 to screw with the female threads 35 of the rear tube 32. The revolving base 5 further has its upper end provided with a ring 53 for the outer end of the rear tube 32 to rest thereon.

The revolving cover 6 to be covered around the revolving base 5 and the rear tube 32 has its front end formed with a projection ring 61 on the inner wall to be rotatably fitting with the recessed ring 36 in the outer wall of the rear tube 32. Besides, the revolving cover 6 is provided with a plurality of elongate projections 62 on the inner wall to respectively fitting with the notches 54 on the outer circumferential edge of the engage ring 53 of the revolving base 5.

Figure 2:
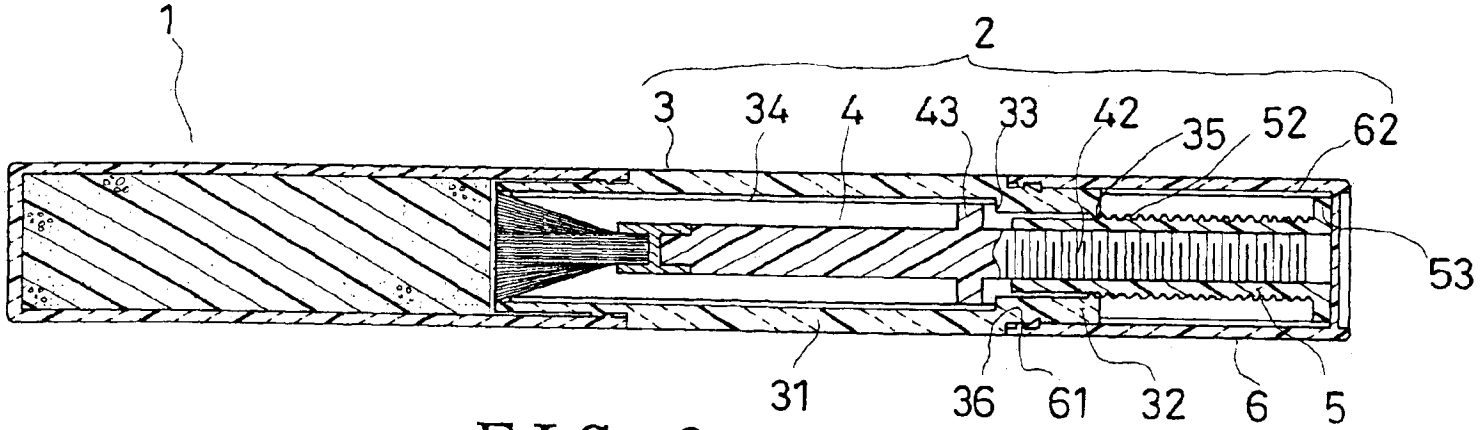
FIG. 2 is a cross-sectional view of the cosmetics container in the present invention.
Figure 4:
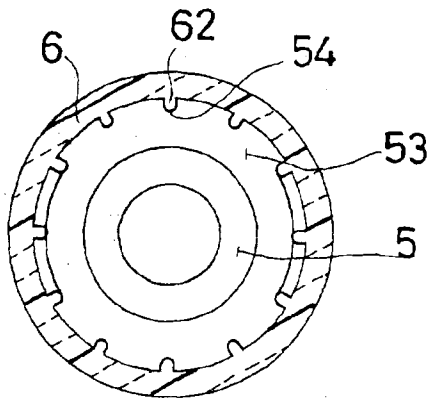
FIG. 4 is a side cross-sectional view of the cosmetics container in the present invention, showing the elongate projections fitted with the notches of the revolving base.
Figure 3:
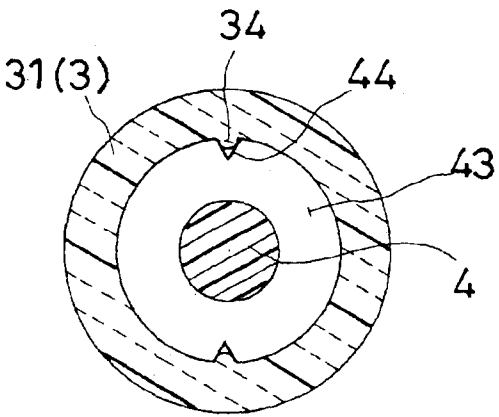
FIG. 3 is a side cross-sectional view of the cosmetics container in the present invention, showing the guide grooves of the brush fitted with the elongate guide projections of the front tube.
Figure 5:
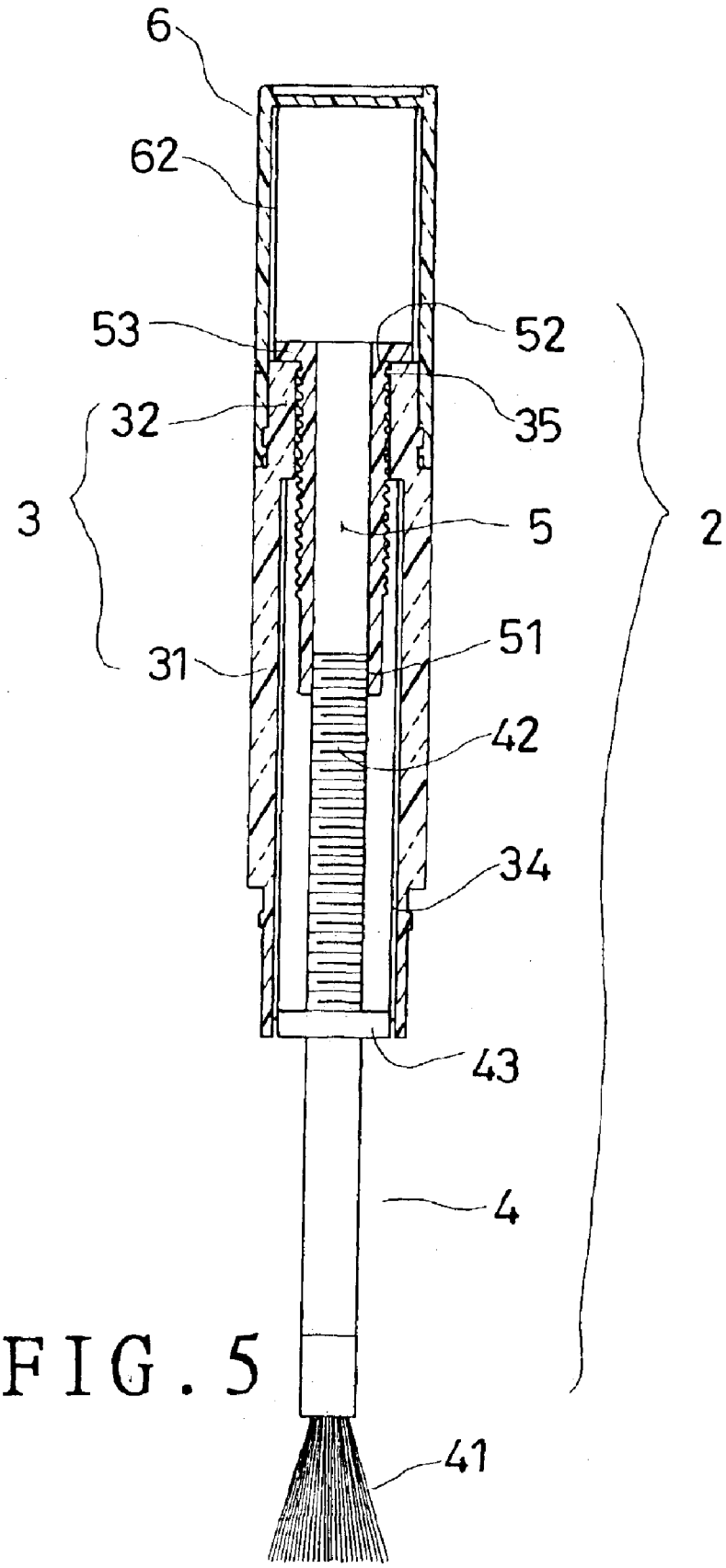
FIG. 5 is a cross-sectional view of the cosmetics container in a using condition in the present invention.
Figure 6:
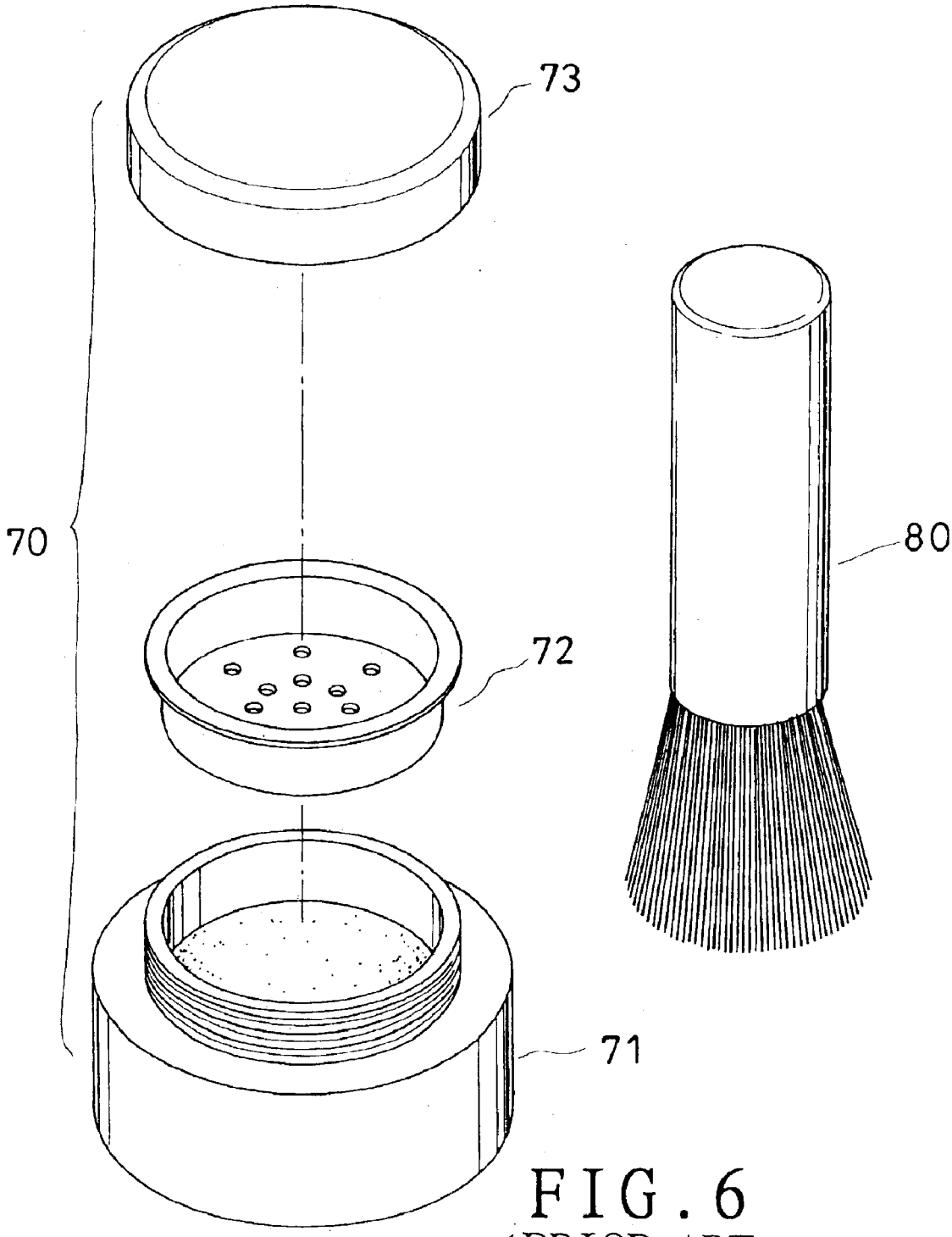
FIG. 6 (PRIOR ART)
FIG. 6 is an exploded perspective view of a conventional cosmetics container.

Normally, the cover unit 2 is covered on the container 1 and the brush 4 is positioned in the cover unit 2, as shown in FIG. 2.

In using, as shown in FIGS. 2 to 5, the cover unit 2 is first released from the container 1. Then, the revolving cover 6 is turned clockwise to move forward together with the revolving base 5, which has its notches 54 fitting with the elongate projections 62 of the revolving cover 6. Since the revolving base 5 has its right-handed threads portion 52 screwing with the female threads 35 of the rear tube 32 and its threaded hole 51 screwing with the reversely threaded portion 42 of the brush, therefore when the revolving base 5 is rotated to move toward the interior of the rear tube 32, the brush 4 will simultaneously be actuated to move forward together and have its brushing member 41 extending out of the front tube 31. Thus, a user can do makeup by holding the cover unit 2 and using the brush 41 for tingeing the cosmetics in the container 1.

On the contrary, if the revolving cover 6 is turned counterclockwise, the brush 4 will be actuated to rotate to move back into the cover unit 2.

As can be understood from the above description, this invention has the following advantages.

1. The cosmetics container is composed of the container 1 for storing cosmetics and the cover unit 2 for positioning the brush 4, having small dimensions and not taking much space in a bag.

2. After the container 1 and the cover unit 2 are assembled together, the brush 4 is always kept in the cover unit 2, impossible for a user to forget bringing either of the cosmetics or the brush.

While the preferred embodiment of the invention has been described above, it will be recognized and under stood that various modifications may be made therein and the appended claims are intended to cover all such modifications that may fall within the spirit and scope of the invention.

What is claimed is:

1. A cosmetics container comprising a hollow container and a cover unit, said cover unit composed of a connecting cover, a brush, a revolving base and a revolving cover, said connecting cover being a hollow tube having opposite ends respectively formed with an opening, said brush having one end provided with a brushing member and the other end formed with a reversely threaded portion, said reversely threaded portion of said brush inserted through said connecting cover, said brush having its intermediate portion provided with a stop ring, said stop ring having its outer circumferential edge formed with guide grooves, said guide grooves respectively fitted with elongate projections on the inner wall of said connecting cover, said revolving base having its lower end bored with a threaded hole, said threaded hole screwing with said reversely threaded portion of said brush, said revolving base having its outer wall formed with a right-handed threaded portion, said right-handed threaded portion screwing with female threads of said connecting cover, said revolving base further having its upper end fixed with a ring, said revolving cover fitted around said revolving base and the upper end of said connecting cover, said revolving cover provided with a plurality of elongate projections on the inner wall, said elongate projections of said revolving cover respectively fitting with notches around the outer circumferential edge of said ring of said revolving base, said revolving cover turned around to move forward together with said revolving base, said brush being moved forward and extending out of said connecting cover.

2. The cosmetics container as claimed in claim 1, wherein said revolving cover has its lower end formed with a projecting ring on the inner wall to rotatably fit with a recessed ring in the outer wall of said connecting cover.

* * * * *